US005785125A

United States Patent [19]

Royer

[11] Patent Number: 5,785,125

[45] Date of Patent: Jul. 28, 1998

[54] MECHANICAL THRU-TUBING CENTRALIZER

[75] Inventor: Edward S. Royer, Houston, Tex.

[73] Assignee: TIW Corporation, Houston, Tex.

[21] Appl. No.: 735,805

[22] Filed: Oct. 21, 1996

[51] Int. Cl.[6] ..... E21B 17/10

[52] U.S. Cl. ..... 166/380; 166/241.1; 166/241.6

[58] Field of Search ..... 166/241.1, 241.3, 166/241.5, 241.6, 241.7, 380, 381; 175/325.3

[56] References Cited

U.S. PATENT DOCUMENTS

| | | | |
|---|---|---|---|
| 1,824,466 | 9/1931 | Griley | 175/325.3 |
| 2,368,737 | 2/1945 | Badgley | 166/241.1 X |
| 2,679,903 | 6/1954 | McGowen, Jr. et al. | 166/241.1 X |
| 2,891,769 | 6/1959 | Page, Sr. et al. . | |
| 3,298,449 | 1/1967 | Bachman et al. . | |
| 4,039,026 | 8/1977 | Yonker | 166/117.5 |
| 4,185,704 | 1/1980 | Nixon, Jr. . | |
| 4,270,619 | 6/1981 | Base | 175/61 |
| 4,388,974 | 6/1983 | Jones, Jr. et al. | 175/325 |
| 4,394,881 | 7/1983 | Shirley | 175/76 |
| 4,407,377 | 10/1983 | Russell | 175/325 |
| 4,471,843 | 9/1984 | Jones, Jr. et al. | 175/73 |
| 4,830,105 | 5/1989 | Petermann | 166/241.1 |
| 4,842,083 | 6/1989 | Raney | 175/325 |
| 4,854,403 | 8/1989 | Ostertag et al. | 175/325 |
| 5,358,040 | 10/1994 | Kinley et al. | 166/241.3 |

FOREIGN PATENT DOCUMENTS

WO 92/09783 6/1992 WIPO .

OTHER PUBLICATIONS

Tri-State Oil Tools Advertisement, Cover Page, pp. 20 and 27 (undated).

*Primary Examiner*—George A. Suchfield
*Attorney, Agent, or Firm*—Browning Bushman

[57] ABSTRACT

Mechanical thru-tubing centralizers 12, 14 positioned along a work string WS centralize a tool such as an abrasive cutter AC within a large diameter casing C after passing through a small diameter tubing T. The centralizer 12 includes a body 60 having a throughbore 62 for transmitting fluid through the centralizer to the abrasive cutter AC. The centralizer 12 also includes arm support sleeves 44, 46 each movable axially between a set position and a retracted position in response to the biasing forces of coil springs 40, 42. The springs 40, 42 bias the arm support sleeves, such that a plurality of circumferentially spaced upper arms 48 and a corresponding plurality of circumferentially spaced lower arms 50 are each inclined with respect to the centralizer body 60. Pads 52 pivotally connected to the upper and lower arms are substantially moved radially outward with respect to the centralizer body and thus engage the inner diameter of the casing string C to maintain the centralizer in a set position. Run-in and retrieval of the centralizer is accomplished by simply lowering or raising the work string WS.

20 Claims, 3 Drawing Sheets

MECHANICAL THRU-TUBING CENTRALIZER

FIELD OF THE INVENTION

The present invention relates to a downhole thru-tubing centralizer of the type commonly used to desirably position the axis of a tubular within a larger diameter casing string after passing the centralizer through a small diameter tubular string. The centralizer is mechanically biased to the set position, and may be repeatedly expanded downhole into engagement with a larger diameter casing string and subsequently retracted to pass into and through the small diameter tubing string both during the run in and retrieval operations.

BACKGROUND OF THE INVENTION

Various downhole hydrocarbon recovery operations are more reliably performed, or may only be performed, when a tubular (or a tool positioned along a tubular) is desirably positioned radially within a casing string. For example, a downhole tool may be set within the casing string with the axis of the tool aligned with the casing string. Another tool at a lower end of the tubular may need to be interconnected with the set tool, and this connection requires that the tubular and thus the tool suspended therefrom be properly centered within the casing string. In other cases, a tubular may be run in a highly inclined or horizontal well, so that gravity tends to position the tubular for engaging a low side of the casing string. By centering the tubular within the casing string, wear between the tubular and the casing string may be reduced. In still other operations, the downhole tool must be centered within the tubular to reliably perform its intended function.

Numerous types of downhole centralizers have been devised. U.S. Pat. Nos. 2,891,769, 3,298,449, 4,185,704, 4,270,619, 4,388,974, 4,394,881, 4,404,377, 4,471,843, 4,842,083, and 4,854,403 disclose downhole tools with pads, blades, or buttons that move radially outward to either centralize or offset a tubular within a well. Other exemplary tools are disclosed in PCT Publication No. WO 92/09783and Russian Patent No. 541012. Most of these tools are very complex and are thus expensive to manufacture and difficult to maintain. Because many of these tools are complex, they are also not highly reliable and their operation requires a large amount of training and experience.

A hydraulic stabilizer manufactured by Tri-State Oil Tools was developed to be run above cutters. The stabilizer centralizes a work string when cutting. Stabilizer arms include pads for engaging the I.D. of a casing. The stabilizer mandrel rotates with the work string while heavy duty bearings allow the arms and pads to remain stationary. The stabilizer arms expand outward in response to increased hydraulic pressure. When pump pressure is stopped, the stabilizer collapses.

Particular problems are encountered when it is necessary to centralize a tubular within a casing string below a small diameter tubing string. A centralizer positioned along the tubular must pass through the small diameter tubing string and be set at the desired axial position within the casing string below a lower end of the tubing string. To first position the centralizer at its desired axial position within the casing string, the centralizer must be small enough to pass through the tubing string, and an expanded position of the centralizer must be large enough to engage the inner wall of the large diameter casing string. It is generally preferably that, after the centralizing operation is complete, the centralizer again be moved to a retracted position so that it may be returned to the surface through the small diameter tubing string.

In many applications, the throughbore in the centralizer body desirably does not substantially restrict the flow of fluid through the tubular. Accordingly, there is very little wall thickness between the diameter of the centralizer body throughbore and the outer surface of the centralizer. This problem is particularly of concern in thru-tubing applications, since flow through the centralizer is desirably not significantly restricted. Moreover, the centralizer must be sized when retracted for passing through the small diameter tubing string, then the centralizer must be set for centering the tubular in a much larger diameter casing string.

Applications involving thru-tubing abrasive cutting operations require that the abrasive cutter and the centralizer which radially centers the cutter in the casing string have a sufficiently small diameter to be conveyed by the work string through a small inside diameter tubing string and then operated within a larger inside diameter casing string to cut the casing string at a location below the tubing string. In situations in where the abrasive cutter is used to cut a highly deviated casing and in applications where lateral wellbores are drilled from the casing below a tubing string and the abrasive cutter is used to cut the casing or other tubular positioned within the lateral, the abrasive cutter may be unable to reliably cut the tubular unless the cutter is centralized within the casing string. Moreover, the abrasive cutter and the work string on which it is positioned desirably rotate during the abrasive cutting operation, yet the pads of the centralizer which position the cutter within the casing string preferably do not rotate against the casing during the cutting operation in order to minimize the torque required to rotate the abrasive cutter.

Prior to the cutting operation, the abrasive cutter and the centralizer are thus passed downhole through a tubing string, and the centralizer is then expanded into a larger diameter casing string at the lower end of the tubing string. After performing the cutting operation, the abrasive cutter and the centralizer are desirably retrieved to the surface through the small diameter tubing string. In at least some applications, the operation of running in the abrasive cutter and the centralizer through the tubing string and the operation of retrieving these components to the surface through the tubing string are compounded by one or more breaks in the length of the tubing string. In other words, the tubing string itself may consist of an upper tubular string and a lower tubular string separated by an axial spacing between the lower end of an upper length of tubing string and the upper end of a lower length of tubing string, thereby making run in and retrieval of the centralizer more difficult.

Prior art centralizers thus have significant disadvantages which have limited there acceptance in the industry. Many centralizers are expensive and difficult to operate, and cannot be utilized in thru-tubing applications. Other centralizers require high axial forces to be transmitted through the work string to set or unset the centralizer.

An improved centralizer is required in order to benefit from the significant advantages of thru-tubing applications which allow operations to be performed downhole below a small diameter tubing string and within a larger diameter casing string. The disadvantages of the prior art are overcome by the present invention, and an improved downhole centralizer and an improved method of positioning, setting, and retrieving a downhole centralizer are hereinafter disclosed which have particular utility in thru-tubing operations.

SUMMARY OF THE INVENTION

A suitable embodiment of a mechanical thru-tubing and self-centering centralizer according to the present invention includes an upper centralizer having upper and lower threaded ends for positioning along a work string. A tool, such as an abrasive cutter, may be positioned below the upper centralizer. Below the abrasive cutter may be positioned a lower centralizer having upper and lower threaded ends for positioning along the work string. Positioning the abrasive cutter between the centralizers ensures that the abrasive cutter will be centralized within the casing string. The abrasive cutter and centralizers may be lowered through a small diameter tubing string to a desired position in a casing string, or through a series of alternating small diameter tubing strings and large diameter casing strings. The centralizer will automatically engage the inner wall of the tubing string at the point of entry and will expand to a fully set position inside each casing string. The expanding and retracting action of the centralizer is the same for run in and retrieval operations. Thus, the centralizers and abrasive cutter may be positioned and repositioned as needed. Further, while the work string including the abrasive cutter rotates during operation, the centralizers do not rotate, thereby minimizing torque on the work string.

A centralizer body thus includes arm support sleeves at both the upper end of the upper arms and the lower ends of the lower arms. The sleeves are axially movable relative to the centralizer body between a set stop position (expanded) and a fully retracted position, with movement of the arm support sleeves being controlled by coil springs. The springs are positioned between the upper and lower support sleeves and the upper and lower threaded ends, respectively. The lower end of the upper spring is set within an annular recess, and a ring with a friction reducing washer is positioned between the support sleeve and the ring. Likewise, the upper end of the lower spring is set within a recessed area in a ring, and a friction reducing washer is positioned between the support sleeve and the ring. Accordingly, the centralizer arms will remain rotationally stationary during a work string rotating operation yet will be able to move axially within the casing string during such rotation.

A plurality of circumferentially spaced upper arms are each pivotally connected at an upper end to the lower end of the centralizer upper support sleeve, and a corresponding plurality of circumferentially spaced lower arms are each pivotally connected at a lower end to the upper end of the centralizer lower support sleeve. The lower end of the upper arms are each pivotally connected to the upper end of a centralizer pad, and the upper end of the lower arms are each pivotally connected to the lower end of a centralizer pad. When the centralizer is in the set position, the springs are fully released to the stop set position along the mandrel or centralizer body, whereby the centralizer pads engage the casing string to automatically centralize the work string. When the centralizer enters a smaller diameter tubing string, the axial force on the work string will inherently retract the arms. When the arms are fully retracted inside the tubing string, the biasing force of the springs being equal and will automatically axially center the centralizer arms and pads assembly with respect to the centralizer body.

An object of the present invention is to provide a relatively simple and highly reliable centralizer for positioning along a tubular. The tubular and centralizer may be lowered through a small diameter tubing string into a selected axial position within a large diameter casing string below a lower end of the tubing string. Alternatively, the centralizer may be lowered through a series of small diameter tubing strings and into a selected axial position within a large diameter casing string below a lower end of a tubing string, with the centralizer serving to radially position the axis of the work string with respect to the axis of the casing string. A related object of the invention is to ensure that, after the centralizing operation is complete, the centralizer may be returned to the surface through the small diameter tubing string.

Another object of the present invention is to provide a centralizer which may expand dramatically from a retracted position to a set position in response to spring expansion while maintaining a relatively large diameter throughbore through the centralizer body for passing fluids through the centralizer when in either the retracted or the set position.

A feature of the present invention is that the centralizer is responsive to a force on the tubing string causing the collapsing of the centralizer arms and simultaneous compression of the springs when the centralizer is moved into the upper end of a tubing string when being moved downhole or is moved into the lower end of the tubing string when being returned to the surface.

Another feature of the invention is that the centralizer may be used to centralize a desired tool within the casing string, with the desired tool either being rotatable or fixed with respect to the work string. Rotation of the work string may be powered at the surface or by a downhole motor. When the tool is an abrasive cutter, the centralized tool may reliably cut a window in the casing string. The centralizer and the tool may then be returned to the surface through the small diameter tubing string.

Yet another feature of the invention is that the expandable centralizer arms are rotationally independent relative to the centralizer body. This allows the arms to remain stationary when the centralizer body is rotating.

An advantage of the present invention is that the centralizer is relatively simple, and has few moving parts. The centralizer is thus comparatively inexpensive to manufacture and may be easily serviced and repaired. This allows the centralizer to be reliably utilized with little training and experience.

These and further objects, features, and advantages of the present invention will become apparent from the following detailed description, wherein reference is made to the figures in the accompanying drawing.

DETAILED DESCRIPTION OF THE PREFERRED EMBODIMENTS

Figure 1:
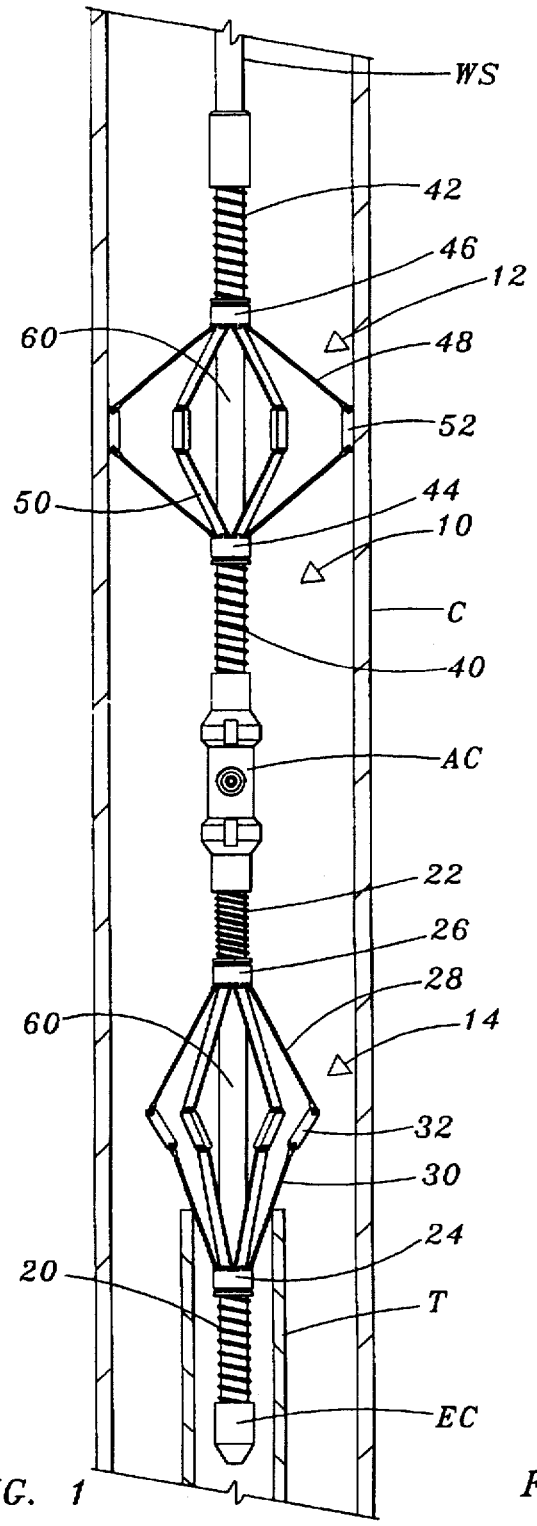
FIG. 1 is a pictorial representation of an upper centralizer, an abrasive cutting tool, and a lower centralizer positioned within a wellbore. The upper centralizer is expanded into engagement with a casing string, and the lower centralizer is partially retracted as it is being forced downhole into the small diameter tubing string.
Figure 2:
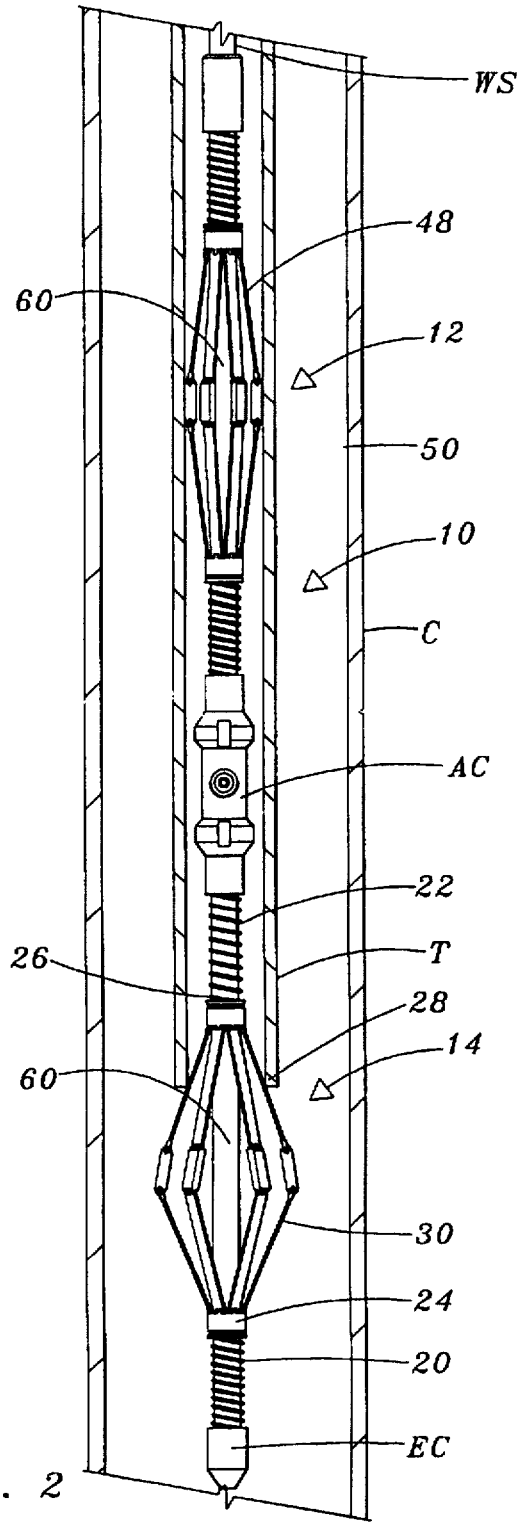
FIG. 2 is a pictorial view of an upper centralizer, an abrasive cutting tool, and a lower centralizer as shown in FIG. 1. The upper centralizer is fully retracted within the tubing string, and a lower centralizer is shown in its partially retracted position as the work string is being pulled upward within the tubing string.

FIGS. 1 and 2 illustrate a suitable application for a mechanical thru-tubing centralizer according to the present invention. A centralizer and an abrasive cutting assembly 10 comprising an upper centralizer 12, an intermediate abrasive cutter AC, and a lower centralizer 14 may be suspended in the well from a work string WS. While the assembly 10 may be suspended in a well from any type of small diameter oilfield tubular, the centralizers of the present invention are particularly well suited for use with a work string WS comprising tubular joints with threaded ends, since significant axial forces may then be transmitted through the work string to the centralizer, as described subsequently.

For the embodiment as shown in FIGS. 1 and 2, the assembly 10 is positioned within a well including a large diameter casing C and a smaller diameter tubing T centrally positioned within the casing C. Each of the components of the assembly 10 are thru-tubing components capable of being passed through a smaller diameter upper tubing string (not shown in FIGS. 1 and 2) which may extend from the surface of the well to a downhole position within the casing string C. For the particular embodiment as shown in FIGS. 1 and 2, it is thus assumed that the upper tubular string terminates at a position above the upper end of the tubular T shown in FIGS. 1 and 2. The upper tubular string may be sized with the same internal and exterior diameters as the tubular T. In an exemplary application, the tubular T has an internal diameter of approximately 5.75 inches. Each of the upper centralizer 12 and the lower centralizer 14 may expand into engagement with a casing string C having an internal diameter of up to approximately 26 inches. The terms tubing string, casing string, and work string as used herein are relative terms and may be applied to various types of oilfield tubulars which generally have increasing diameters as shown in FIGS. 1 and 2 so that the tubing T may be passed through the casing C, and the work string WS may subsequently be passed through the tubing T.

The assembly 10 may thus be lowered into the well from a work string WS and passed through an upper tubular string then out the lower end of the upper tubular string. As each of the centralizers 12 and 14 exits the lower end of the upper tubular string, each centralizer will automatically expand radially, as explained subsequently, so that each centralizer 12 and 14 has an expanded configuration, as shown for the centralizer 12 in FIG. 1, and as more fully depicted in FIG. 4. More particularly, as the lower centralizer 14 passes below the lowermost end of the upper tubular string, the biasing force of the compression springs 20 and 22 push the support sleeves 24 and 26 axially toward each other, thereby causing the plurality of circumferentially spaced upper arms 28, the lower arms 30, and the pads 32 to move to their set or expanded position, such that the pads 32 engage the interior of the casing C. Similarly, when the upper centralizer 12 passes through the lowermost end of the upper tubular string, its compression springs 40 and 42 similarly move the respective support sleeves 44 and 46 axially together, thereby causing the upper arms 48, the lower arms 50, and the pads 52 of the upper centralizer to move into the set positions so that the pads 52 engage the interior of the casing C. In this configuration, the assembly 10 may thus be further lowered within the casing string C.

With the centralizers 12 and 14 serving their intended function, the abrasive cutter AC is centrally positioned within the casing C. Accordingly, when the abrasive cutter AC is at its desired depth within the well, a conventional motor at the surface may be used to rotate the work string WS and thus the abrasive cutter AC. Pressurized fluid may be passed through the work string WS, including the interior of the centralizers 12 and 14. A plug or end cap EC at the lower end of the work string WS may be used to limit the discharge of pressurized fluid from the work string WS, and accordingly the build up of pressure within the work string WS may be used to activate the abrasive cutter AC and thus cut a window within the casing C. Other details with respect to a suitable abrasive cutter AC according to the present invention are disclosed in pending U.S. application Ser. No. 08/315,928 filed Sep. 30, 1994.

For the particular application as shown in FIGS. 1 and 2, it will be presumed that the operator desires to use the abrasive cutter AC to also cut another window in a casing C at a position below the lower end of the tubular T. As the assembly 10 as shown in FIG. 1 is lowered to the lower tubular, the lower arms 30 of centralizer 14 engage the uppermost end of the tubular T. With the upper centralizer 12 remaining in its set position with pads 52 engaging the casing C, the further downward movement of the work string WS will cause the lower centralizer 14 to begin to collapse, as shown in FIG. 1. As the downward force of the work string WS causes the lower arms 30 to collapse, this action in turn will be transmitted through the upper arms 28 so that the support sleeve 26 moves upward, thereby compressing the coil spring 22. Continued downward movement of the work string WS will cause the entirety of the arms 30, the pads 32, and the arms 28 of the lower centralizer 14 to move within the interior of the tubing T, at which time the biasing force of the upper coil spring 22 to be greater than the biasing force of the lower coil spring 20. Once the pads 32 move into the interior of the tubing string T, the axial forces of the coil springs 22 equalizes (thus moving the sleeves 26 and 24 and the arms 28 and 30 downward from the position as shown in FIG. 1), thereby causing the arms 28 and 30 and the support pads 26, 28 to again be longitudinally centered along the body 60 of the lower centralizer 14.

The work string WS may then be lowered so that the abrasive cutter AC enters the interior of the tubular T, with the lower centralizer 14 within the tubular T and the upper centralizer 12 within the casing C centralizing the abrasive cutter for entering the interior of the tubular T. The abrasive cutter AC has a diameter slightly less than the interior diameter of the tubular T, and is thus able to easily pass into and through the tubular T. The continued lowering of the work string WS will then cause the upper centralizer 12 to similarly engage the upper end of the tubular T, and the continued lowering of the work string WS will thus compress the upper centralizer 12 so that it is positioned within the tubular T in the same manner as the lower centralizer 14. It should thus be understood that the upper centralizer 12 and the lower centralizer 14 may be identical in structure and operation.

The work string WS may be further lowered through the tubing T with the centralizers 12 and 14 and the intermediate abrasive cutter AC passing as an assembly 10 through the tubular T. The centralizers 12 and 14 may then exit the lower end of the tubular T and, during this lowering process, each centralizer will automatically expand into engagement with the casing C, as described above. With the centralizers 12 and 14 expanded for engagement with the casing C, the assembly 10 may then be lowered to its desired position within the casing C below the lowermost end of the tubular T, and the abrasive cutting operation commenced, as described above, by passing fluid through the work string WS and the upper centralizer 12. The pressurized fluid is then ejected through the abrasive cutter AC for the cutting operation.

FIG. 2 illustrates the retrieval of the assembly 10 through the tubing string T. As a work string WS is pulled upward within the casing string C, the upper arms 48 of the upper centralizer 12 first engage the lowermost end of the tubular T and begin collapsing the arms so that the entirety of the upper centralizer 12 will pass into the interior of the tubing T. As shown in FIG. 2, the abrasive cutter AC may then be positioned within the tubular T, and the upper arms 28 of the lower centralizer 14 then engaged by the lowermost end of the tubular T. As shown in FIG. 2, this action will compress the lower coil spring 20 of the lower centralizer 14, so that the entirety of the lower centralizer 14 may then also be positioned within and passed through the tubular T. Support sleeve 24 may thus move axially downward toward the end cap EC to compress the coil spring 22 as the work string WS is pulled upward, thereby collapsing the arms of the lower centralizer 14. Once the lower centralizer is fully positioned within the tubular T, the increased biasing force of the lower coil spring 20 will act against the biasing force of the upper coil spring 22, thereby longitudinally centralizing the arms 30 and 28 and the pads 32 along the length of the body 60, so that the lower centralizer 14 will pass through the tubular T in the centralized position as shown for the upper centralizer 12 in FIG. 2.

As the assembly 10 is pulled upward to the surface, both the upper centralizer and lower centralizer will exit the uppermost end of the tubular T and will expand into full engagement with the casing C. Each centralizer 12 and 14 may then collapse in the manner described above as each centralizer engages the lowermost end of the upper tubular string. The entirety of the assembly 10 may then be retrieved to the surface. Accordingly, it should be understood that the centralizers of this invention are well suited for running in and pulling out of a well with any number of axially spaced tubulars therein. The tubulars may be axially spaced such that the lower end of an upper tubular is spaced above an upper end of a lower tubular. The centralizer of this invention is also well suited for use in a thru-tubing operation having a single tubular extending from the surface to a downhole location above the location where the centralizer is to serve its intended function of centralizing the tool or work string within a larger diameter casing.

Although two centralizers are described above for centralizing the work string WS and thus the abrasive cutter AC within the casing C, in some applications a single centralizer may be positioned immediately above or below the abrasive cutter AC for accomplishing the centralizing purpose. Also, those skilled in the art will appreciate that additional centralizers each structurally and operationally similar to the centralizers 12 and 14 may be used along the length of the work string WS for centralizing the work string and tools along the work string within the well, while allowing the centralizers and the tools to pass through a small diameter tubing string T. The centralizers of the present invention are particularly well suited for use in highly inclined and horizontal wellbore applications. Without the centralizers, the abrasive cutter AC would tend to drop to the bottom of the casing C and in that position would not be properly centered for cutting a desired window within the casing C. Those skilled in the art will appreciate that there may be significant axial spacing between the lowermost end of the upper tubular string and the upper most end of the tubing T shown in FIG. 1. In other applications, however, there may be a relatively short break in the axial length of the tubing, in which case the abrasive cutter AC may be centralized within the casing C with one of the centralizer 12 and 14 engaging and centered within the casing, and the other of the centralizer 12 and 14 engaging and centered within the tubing T.

Figure 3:
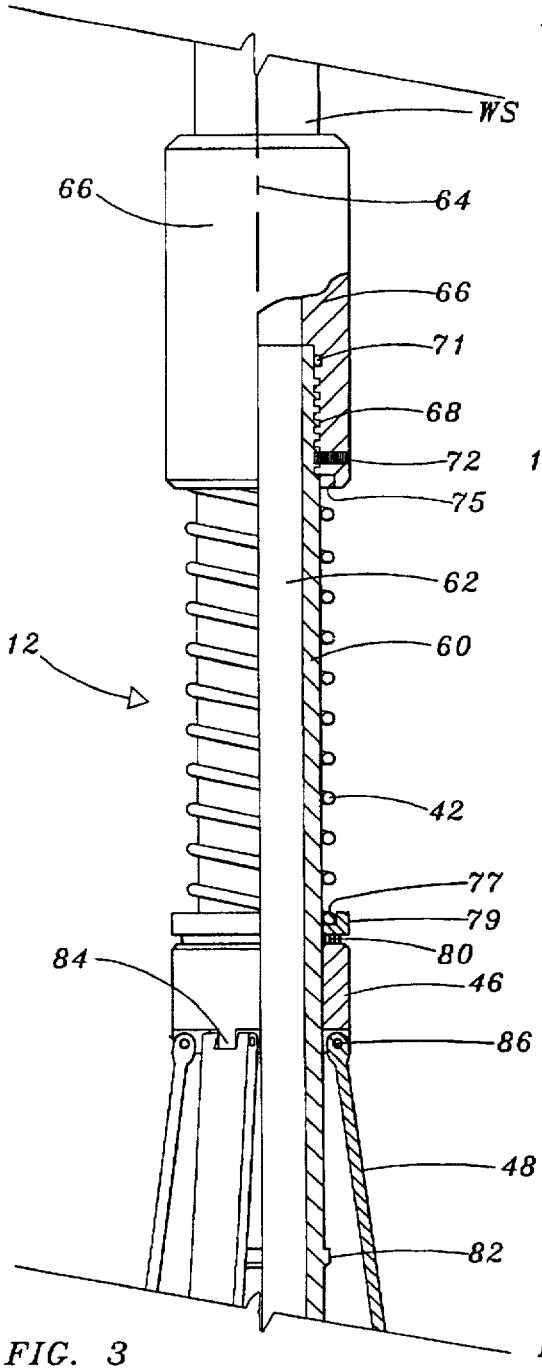
FIG. 3 is a detailed cross-sectional view of an upper portion of the upper centralizer as shown in FIGS. 1 and 2 in a partially retracted position.

FIG. 3 illustrates in greater detail the components of a suitable mechanical thru-tubing centralizer 12 according to the present invention. The centralizer 12 includes an elongate centralizer body 60 having a central throughbore 62 therein for transmitting fluid to the abrasive cutter AC. The body 60 is generally centrally positioned about the centralizer axis 64 which passes through the throughbore. A top sub 66 may be threaded at its uppermost end for conventional engagement with the work string WS. The lower end of sub 66 is threadedly connected to the upper end of the centralizer body 60 by threads 68, and is sealed to the body 60 by the O-ring 71. A set screw 72 is positioned within the sub 66 for securing the engagement with centralizer body 60. An annular cavity 75 in the lowermost end of the sub 66 is provided for receiving the uppermost end of the upper coil spring 42. The lowermost end of the upper coil spring 42 sits within a similar annular cavity 77 in a ring 79. A friction reducing washer 80 is positioned immediately below the ring 79 and immediately above the upper support sleeve 46. In a preferred embodiment, the friction reducing washer 80 may be fabricated of Teflon® or graphite. The ring 79, the washer 80, and the upper support sleeve 46 are axially or longitudinally movable along the centralizer body 60. Thus during expansion of the centralizer 12 to the position as shown in FIG. 1, the spring 42 exerts a downward force on the ring 79 and the upper support sleeve 46 to move the support sleeve 46 towards the upper set stop 82 fixed to the body 60. The upper set stop 82 for the present embodiment may be machined in the centralizer body 60. It should be understood that the set stop need not be a machined part of the centralizer body, however, and instead the set stop may be any device which could be reliably secured to the centralizer body and restrict the axial movement of a support sleeve while not interfering with the radial movement of the arms 48, 50 or the pads 52.

Figure 4:
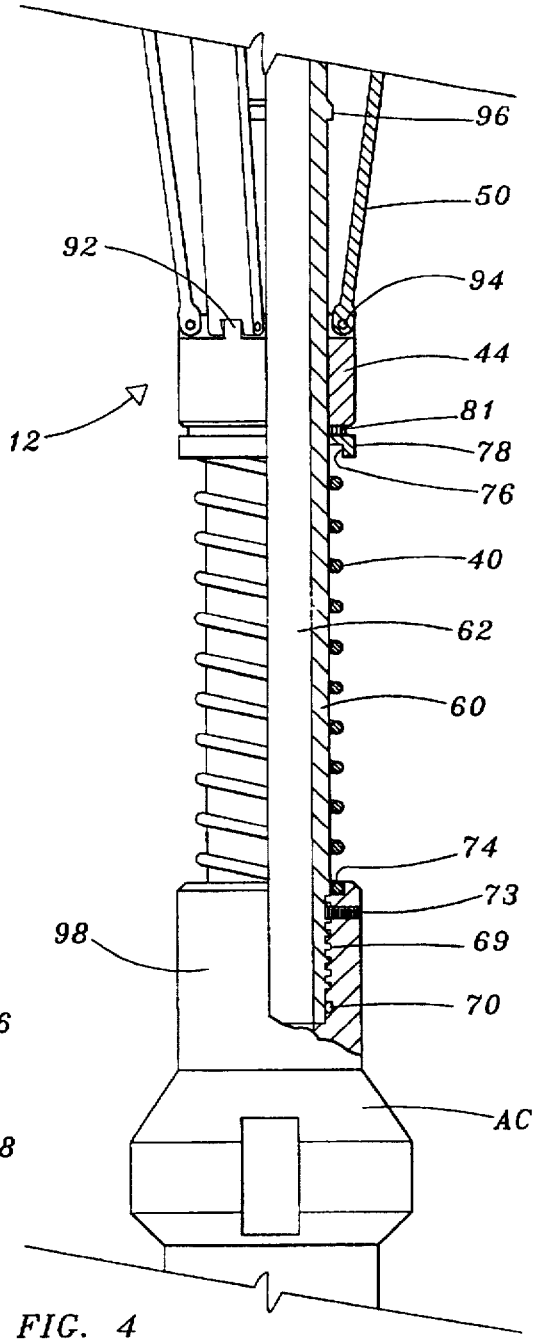
FIG. 4 is a detailed cross-sectional view of a lower portion of the upper centralizer as shown in FIGS. 1 and 2 in a partially retracted position.
Figure 5:
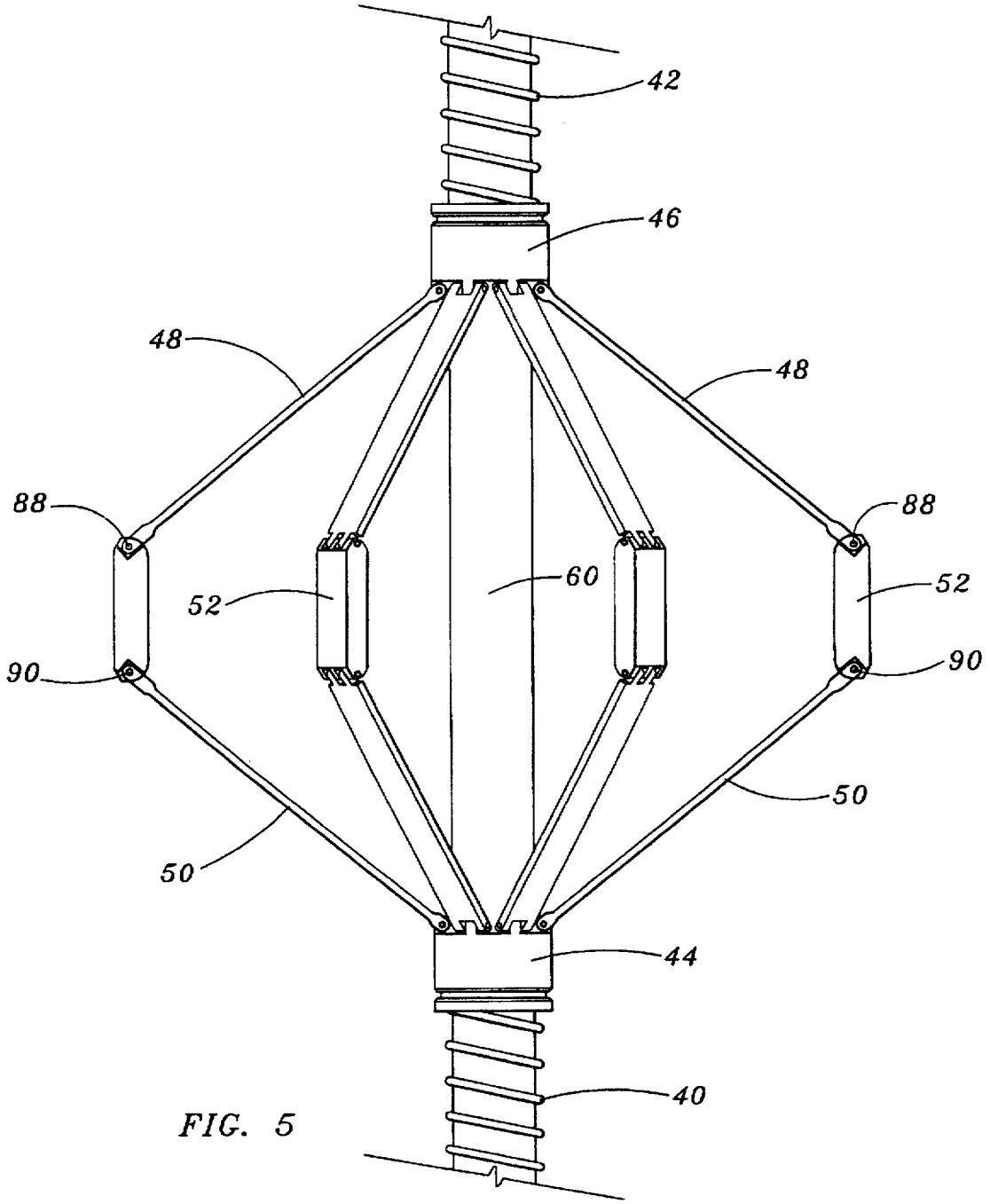
FIG. 5 is a detailed cross-sectional view of a central portion of a centralizer according to the present invention in an expanded position.

As is suggested by FIG. 3, four upper and lower arms 48 spaced at 90° intervals may be provided in a preferred embodiment of a centralizer. Each of the circumferentially spaced upper arms 48 is pivotally connected at its uppermost end to an ear 84 extending downward from and secured to the arm support sleeve 46. The upper arms 48 and ears 84 are connected by a common pin 86. As shown in FIG. 5, the lowermost end of the upper arms 48 are each pivotally connected to the uppermost end of pads 52 by a common pin 88. The lowermost end of each pad 52 is pivotally connected to the uppermost end of a circumferentially spaced lower arm 50 by a common pin 90. As shown in FIG. 4, the lowermost end of each lower arm 50 is connected to an ear 92 which extends upward from the lower support sleeve 44 by a common pin 94. Support sleeve 44 is axially movable along the centralizer body 60. A similar machined lower set stop 96 limits the upward travel of the lower support sleeve 44.

In the similar manner as previously described for the upper support sleeve 46, a friction reducing washer 81 is sandwiched between the lowermost end of the lower support sleeve 44 and a ring 78. The ring 78 has an annular cavity 76 for engagement with the lower coil spring 40. The lowermost end of the spring 40 sits within an annular cavity 74 in the uppermost end of the lower sub 98. Sub 98 is threadedly connected to the centralizer body 60 by threads 69 and is sealed by the O-ring 70. A set screw 73 is provided in the sub 98 for securing the engagement with the centralizer body 60. The sub 98 is threaded at its lowermost end for conventional engagement with an abrasive cutter AC. It should be understood, however, that any desired tool, such as an end cap, may be threadedly connected to the lowermost end of sub 98 provided the threads are properly matched. Also, the sub 66 or the sub 98 may be a component of the tool above or below the centralizer, e.g., the sub 98 may be a component of the abrasive cutter AC.

The upper support sleeve 46, the upper arms 48, the pads 52, the lower arms 50 and lower support sleeve 44 comprise an axially or longitudinally movable unit which is not required to rotate during rotation of the work string WS and the abrasive cutter AC. The support sleeves 46 and 44 respond to the expansion forces of the coil springs 42 and 40 forcing the arms to become substantially angled or inclined with respect to the central axis 64 of the centralizer body 60. The radially outward exterior curved planar surface of the pads 52 thus engage the inner surface of the casing string CS, as shown in FIG. 1.

Those skilled in the art will appreciate that the pads 52 between the plurality of upper arms 48 and the plurality of lower arms 50 are not essential, and instead the lower arms 52 and the upper arms 48 may be directly pivotally connected. Conceptually, each of the pads 52 may be considered to be the lower end of an upper arm or the upper arm of a lower arm. In any event, at least one of the lower end of the upper arms and the upper end of the lower arms engages the casing string to centralize the centralizer body when the centralizer is in its expanded position.

The downward movement of the work string WS will exert a radially compressive force on the lower arms 50 caused by the engagement of the lower arms with the upper end of the tubular T. The support sleeve 46 is then forced upward to compress the spring 42. Moving the support sleeve 46 upward pulls the plurality of the upper arms 48, the plurality of the pads 52, and the plurality of the lower arms 50 radially inwardly, such that each of the upper and lower arms and pads will be retracted until they move within the tubing string. Once the pads 52 move inside the tubing string T, the arms and pads will move axially so that the biasing force of the lower spring 40 will approximate the biasing force of the upper spring 42. The components of the centralizer 12 radially outward of the body 60 will thus move to an axial or longitudinal equilibrium position. Thereafter, the centralizer may be moved through the small diameter tubing string T.

It is a feature of the present invention that the operation of the centralizer is independent of any hydraulic, pneumatic, or electrical intervention. Each time the centralizer encounters a tubing string during run-in or retrieval, the respective downward or upward forces on the spring opposite the arm in contact with the tubing string will compress the spring and thus allow the plurality of upper arms, the plurality of lower arms, and the plurality of pads to retract. When the centralizer exits the tubing string during run-in or retrieval, the biasing force of the springs pushes the plurality of upper and plurality of lower arms to an expanded position for engagement with the casing string.

It is also a feature of the present invention that the centralizer may be repeatedly moved to a new position within the wellbore by simply raising or lowering the work string. Since the centralizer operates independently of pressure and relies only upon axial movement once it enters the wellbore, positioning of the centralizer may occur at any time. The stops 82 and 96 may be fixed along the length of the body 60 to limit radially outward movement of the arms and the pads. Accordingly, the stops 82 and 96 may be fixed in position so that the pads have a maximum effective diameter slightly less than the internal diameter of the largest casing string in which the centralizer is to serve its centralizing function. As explained above, the centralizer will inherently serve a centralizing function when positioned within any tubular having a diameter less than the internal diameter of the largest casing string corresponding to the position of the set stops. The stops may, if desired, be eliminated, in which case the centralizer will expand to its fullest diameter as permitted by the tubular in which it is placed until the biasing force of the springs is effectively equal to the nominal friction force acting on the centralizer components. Other biasing members, may be used, although coil springs are preferred.

For the embodiments as shown in FIGS. 1–5, each of the plurality of upper arms, each of the plurality of pads, and each of the plurality of lower arms is rotationally independent of the centralizer body 60. It should be understood that by pivotally connecting the upper and lower arms to the support sleeves, the support sleeves are also rotationally independent of the body 60. For many types of centralizers, the components which move radially outward to engage the interior wall of the casing are structurally connected to the rotating work string, which thus inherently results in the rotation of these components with the work string. The present invention allows the centralizer pads to engage the inner diameter of the casing so that the centralizer body structurally connected to the work string may rotate relative to the stationary pads. Since the centralizer may move axially within the wellbore independent of the rotation of the work string, the centralizer setting and collapsing operations may be accomplished without regard to rotation of the work string.

Based on the above disclosure, those skilled in the art will appreciate that the centralizer of the present invention has utility in various application for desirably positioning the axis of the tubular or a tool positioned along a tubular within a casing string, and that the exemplary application described herein for centrally positioning the tubular and thus an abrasive cutter are generally illustrative of a suitable application. The centralizer of the present invention may be used for positioning various types of tubulars centrally within a casing string for engagement, disengagement or cooperation with various types of downhole tools. The centralizer may also be utilized to centrally position a tubular or a tool along a tubular within an open hole which does not include a casing string. Although particularly well suited for use in thru-tubing applications where the centralizer is first passed through a tubing string then set in a casing string, the centralizer also has utility for centralizing a tubular within a casing string wherein the tubular and the centralizer are not passed through or retrieved to the surface through a tubing string.

The foregoing disclosure and description of the centralizer is illustrative and explanatory thereof. It will be appreciated by those skilled in the art that various changes in the size, shape and materials, as well as in the details of the illustrated construction or combinations of features of the centralizer may be made without departing from the spirit of the invention, which is defined by the claims.

What is claimed is:

1. A centralizer positionable along a work string for passing through a tubing string and centralizing the work string within a casing string having a diameter larger than the tubing string, the centralizer comprising:

a centralizer body having a throughbore for transmitting fluid through the centralizer, the centralizer body having a central axis within the throughbore;

an upper arm support sleeve axially movable relative to the centralizer body between a set position and a released position;

an upper biasing member for biasing the upper arm support sleeve to the set position;

a lower arm support sleeve axially movable relative to the centralizer body between a set position and a released position;

a lower biasing member for biasing the lower arm support sleeve to the set position;

an upper ring for engaging an end of the upper biasing member for transmitting a biasing force to the upper arm support sleeve;

a lower ring for engaging an end of the lower biasing member for transmitting a biasing force for the lower arm support sleeve;

an upper friction reducing pad spaced between the upper ring and the upper arm support sleeve;

a lower friction reducing pad spaced between the lower ring and the lower arm support sleeve;

a plurality of circumferentially spaced upper arms each pivotally connected at an upper end to the upper arm support sleeve; and a corresponding plurality of circumferentially spaced lower arms each pivotably connected at a lower end to the lower arm support sleeve and at an upper end to a lower end of a respective one of plurality of the upper arms, such that the plurality of upper arms and the plurality of lower arms are movable between the set position wherein at least one of the lower ends of the upper arms and the upper ends of the lower arms engage the casing string to centralize the work string and a released position wherein the upper arms and the lower arms radially retract with respect to the centralizer body for passing through the tubing string.

2. The centralizer as defined in claim 1, further comprising:

a plurality of the circumferentially spaced pads each interconnected with a lower end of a respective upper arm and an upper end of a respective lower arm, each pad having an outer surface for an engagement with the casing string.

3. The centralizer as defined in claim 1, wherein each of the upper arm support sleeve and the lower arm support sleeve is rotatable about the centralizer body.

4. The centralizer as defined in claim 1, further comprising:

each of the upper biasing member and lower biasing member comprises a coil spring positioned radially outward of the centralizer body.

5. The centralizer as defined in claim 4, further comprising:

the axial biasing force of the upper coil spring approximates the axial biasing force of the lower coil spring.

6. The centralizer as defined in claim 4, wherein the upper coil spring is positioned axially above the upper arm support sleeve and the lower coil spring is positioned axially below the lower arm support sleeve.

7. The centralizer as defined in claim 1, further comprising:

the centralizer body including the upper stop fixed thereon for limiting axial travel of the upper arm support sleeve an the centralizer body; and the centralizer body including a lower stop fixed thereon for limiting said travel of the upper arm support sleeve on the centralizer body.

8. The centralizer as defined in claim 1, wherein:

the plurality of the upper arms comprise at least three circumferentially spaced upper arms and the plurality of lower arms comprise at least three circumferentially spaced lower arms; and each of the upper biasing member and lower biasing member has an axial length at least fifty percent of the axial length of the respective upper arms and lower arms.

9. A method of centralizing a tool positioned within a casing string at a position below a tubing string within the casing string and having a diameter less than the casing string, the method comprising:

mounting an upper arm support sleeve axially movable relative to a centralizer body between a set position and a released position;

mounting a lower arm support sleeve axially movable relative to the centralizer body between a set position and a released position;

biasing the upper arm support sleeve axially downward to the set position;

biasing the lower arm support sleeve axially upward to the set position;

pivotably connecting a plurality of circumferentially spaced upper arms at an upper end to the upper arm support sleeve;

pivotally connecting a corresponding plurality of circumferentially spaced lower arms at a lower end to the lower arm support sleeve and at an upper end to a lower end of a respective one of plurality of the upper arms;

engaging an end of an upper biasing member with an upper ring for transmitting a biasing force to the upper arm support sleeve;

engaging an end of a lower biasing member with a lower ring for transmitting a biasing force to the lower arm support sleeve;

spacing an upper friction reducing pad between the upper ring and the upper arm support sleeve;

spacing a lower friction reducing pad between the lower ring and the lower arm support sleeve;

engaging the plurality of lower arms with the tubing string and moving the work string downward to move the upper arm support sleeve axially upward against its bias;

passing the tool positioned on the work string downhole through the tubing string;

passing the tool past a lower end at the tubing string and into the casing string such that the arms move radially outward to engage the casing string and centralize the tool within the casing string;

engaging the plurality of upper arms with the tubing string and moving the work string upward to move the lower arm support sleeve axially downward against its bias; and passing the tool positioned along the work string upward through the tubing string.

10. The method as defined in claim 9 comprising:

interconnecting each of a plurality of the circumferentially spaced pads with a lower end of a respective upper arm and an upper end of a respective lower arm, each pad having an outer surface for an engagement with the casing string.

11. The method as defined in claim 10, further comprising:

rotatably mounting each of the upper arm support sleeve and the lower arm support sleeve about the centralizer body; and rotating the work string and the centralizer body while the pads are in engagement with the casing string.

12. The method as defined in claim 9, further comprising to:

sizing the axial downward biasing force to approximate the axially upward basing force.

13. The centralizer as defined in claim 1, further comprising:

a plurality of circumferentially spaced pads each interconnected with a lower end of a respective upper arm and a upper end of a respective lower arm, each pad having an outer surface for an engagement with the casing string.

14. A centralizer positionable along a work string for passing through a tubing string and centralizing the work string within a casing string having a diameter larger than the tubing string, the centralizer comprising:

a centralizer body having a throughbore for transmitting fluid through the centralizer, the centralizer body having a central axis within the throughbore;

an upper arm support sleeve axially movable relative to the centralizer body between a set position and a released position;

an upper biasing member for biasing the upper arm support sleeve to the set position;

a lower arm support sleeve axially movable relative to the centralizer body between a set position and a released position;

the centralizer body including an upper stop fixed on the centralizer body for limiting axial travel of the upper arm support sleeve on the centralizer body and thereby limiting radially outward movement of the plurality of upper arms, and a lower stop fixed on the centralizer body for limiting axial travel of the lower arm support sleeve on the centralizer body and thereby limiting radially outward movement of the plurality of lower arms;

a lower biasing member for biasing the lower arm support sleeve to the set position;

a plurality of circumferentially spaced upper arms each pivotally connected at an upper end to the upper arm support sleeve; and a corresponding plurality of circumferentially spaced lower arms each pivotably connected at a lower end to the lower arm support sleeve and at an upper end to a lower end of a respective one of plurality of the upper arms, such that the plurality of upper arms and the plurality of lower arms are movable between the set position wherein at least one of the lower ends of the upper arms and the upper ends of the lower arms engage the casing string to centralize the work string and a released position wherein the upper arms and the lower arms radially retract with respect to the centralizer body for passing through the tubing string.

15. The centralizer as defined in claim 14, further comprising:

a plurality of the circumferentially spaced pads each interconnected with a lower end of a respective upper arm and an upper end of a respective lower arm, each pad having an outer surface for an engagement with the casing string.

16. The centralizer as defined in claim 14, further comprising:

each of the upper biasing member and lower biasing member comprises a coil spring positioned radially outward of the centralizer body.

17. The centralizer as defined in claim 16, further comprising:

the axial biasing force of the upper coil spring approximates the axial biasing force of the lower coil spring.

18. The centralizer as defined in claim 14, further comprising:

an upper ring for engaging an end of the upper biasing member for transmitting a biasing force to the upper arm support sleeve; and a lower ring for engaging an end of the lower biasing member for transmitting a biasing force for the lower arm support sleeve.

19. The centralizer as defined in claim 14, wherein:

the plurality of the upper arms comprise at least three circumferentially spaced upper arms and the plurality of lower arms comprise at least three circumferentially spaced lower arms.

20. The centralizer as defined in claim 14, wherein:

each of the upper biasing member and lower biasing member has an axial length at least fifty percent of the axial length of the respective upper arms and lower arms.

* * * * *